United States Patent [19]

Kung

[11] Patent Number: 5,027,805

[45] Date of Patent: Jul. 2, 1991

[54] SNORKEL ASSEMBLY

[76] Inventor: Kuo-Lang Kung, No. 156-12, How-Hu, How-Hu Li, Chia-Yi City, Taiwan

[21] Appl. No.: 556,941

[22] Filed: Jul. 23, 1990

[51] Int. Cl.[5] ..... B63C 11/16

[52] U.S. Cl. ..... 128/201.11; 128/200.29

[58] Field of Search ..... 128/201.11, 200.29

[56] References Cited

U.S. PATENT DOCUMENTS

| | | | |
|---|---|---|---|
| 908,690 | 1/1909 | Neubert | 128/201.11 |
| 4,022,201 | 5/1977 | Diggs | 128/201.11 |

FOREIGN PATENT DOCUMENTS

| | | | |
|---|---|---|---|
| 164933 | 12/1949 | Austria | 128/201.11 |
| 1139978 | 7/1957 | France | 128/201.11 |
| 1177002 | 4/1959 | France | 128/201.11 |

*Primary Examiner*—Edgar S. Burr
*Assistant Examiner*—Stephen R. Funk
*Attorney, Agent, or Firm*—Kilpatrick & Cody

[57] ABSTRACT

A snorkel assembly of this invention includes a face mask and an elongated flexible air pipe having one end connected to the face mask. A floating body is connected to the other end of the air pipe to expose the other end to the atmosphere.

10 Claims, 5 Drawing Sheets

SNORKEL ASSEMBLY

BACKGROUND OF THE INVENTION

The invention relates to a snorkel assembly, more particularly to snorkel assembly that enables a user to dive below the water surface and remain there indefinitely.

A conventional snorkel is shown in FIG. 1 to comprise a face mask A with a strap A1 so that it may be worn around the head. A rigid air pipe B has a first end connected to the face mask A and a bent water valve end B1 which serves an outlet for air exhaled by the user. A main disadvantage of the above described conventional snorkel is that it limits the user to the depth to which he can swim and return to the surface without breathing. For deeper dives or to prolong the time spent away from the surface, a diver must rely on expensive and heavy oxygen tanks and regulators to supply air.

SUMMARY OF THE INVENTION

Therefore, the main object of this invention is to provide a snorkel assembly which eliminates the need to use oxygen tanks and air regulators.

Another object of the present invention is to provide a snorkel assembly that serves as an indicator to mark on the surface the area below which a diver is swimming, thus reducing the probability of accidents.

Accordingly, a preferred embodiment of a snorkel assembly of this invention comprises a face mask and an elongated flexible air pipe having one end connected to the face mask. A floating body is connected to the other end of the air pipe to expose the other end to the atmosphere.

The floating body includes an inflatable ring shaped air tube and a rigid hollow retaining member connected to the air tube by means of a plurality of upwardly inclining connecting ribs. The retaining member supports the surface end of the air pipe and has a substantially hemispherical outer wall and a substantially funnel shaped inner wall integrally connected to the outer wall. The inner wall has an upper converging end defining an air access opening. The outer wall and the inner wall confine an enclosed cavity. A float valve member is disposed at the air access opening to prevent water from entering the air access opening.

The float valve member has a connecting tube fitted in the air access opening. A cage member is attached to the connecting tube and is disposed outside the air access opening. A floating ball is disposed inside the cage member to prevent water from entering into the retaining member through the connecting tube.

BRIEF DESCRIPTION OF THE DRAWINGS

Other features and advantages of this invention will become apparent in the following detailed description of the preferred embodiments with reference to the accompanying drawings, in which.

DETAILED DESCRIPTION OF THE PREFERRED EMBODIMENTS

Figure 1:
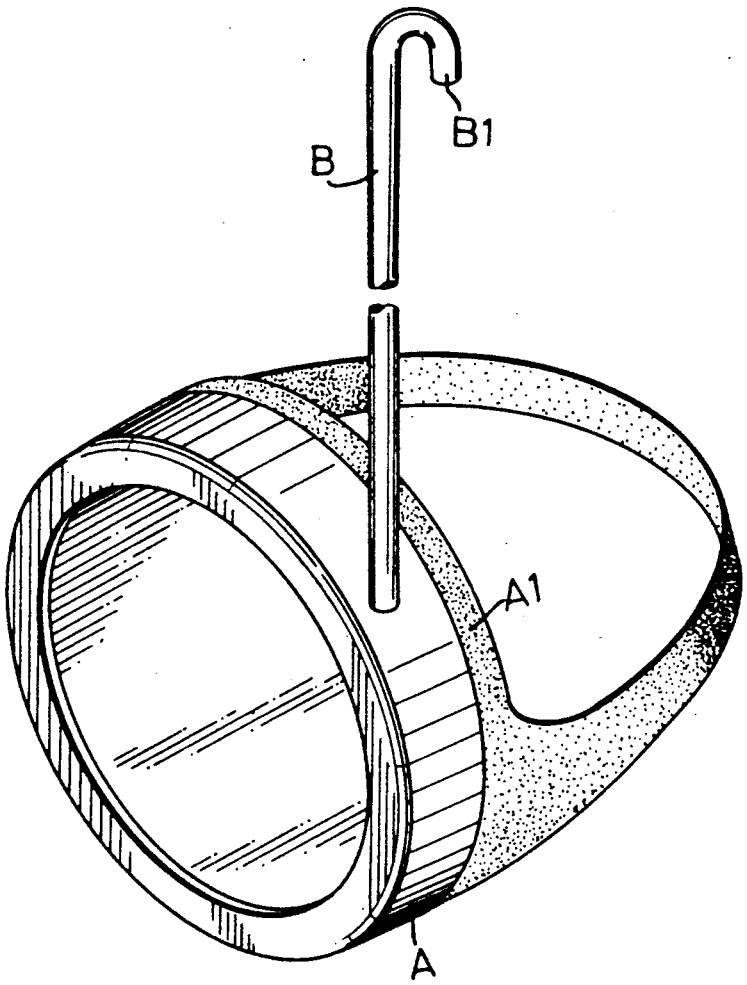
FIG. 1 (PRIOR ART)
FIG. 1 is an illustration of a conventional snorkel.
Figure 2:
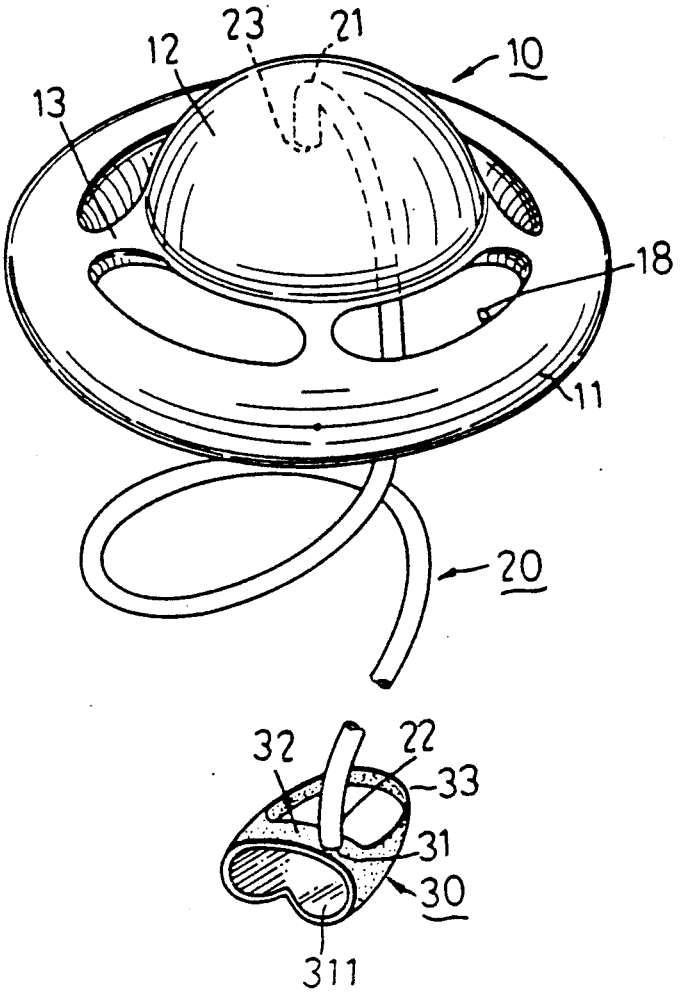
FIG. 2 is a perspective view of a first preferred embodiment of a snorkel assembly according to the present invention.
Figure 3:
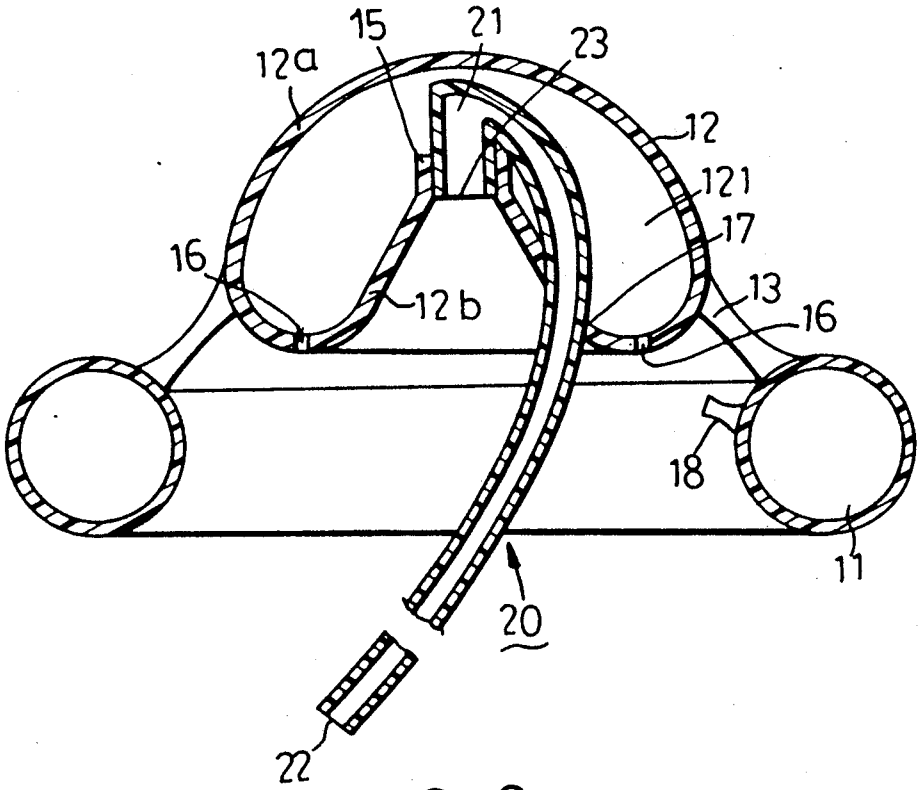
FIG. 3 is a sectional view of the first preferred embodiment of the present invention.

Referring to FIGS. 2 and 3, a first preferred embodiment of the snorkel assembly according to the present invention is shown to comprise a floating body 10, a flexible air pipe 20, and a face mask 30.

The floating body 10 has an annular inflatable air tube 11 and a central rigid hollow retaining member 12 supported by the air tube 11 by means of a plurality of inwardly and upwardly inclining connecting ribs 13. The retaining member 12 has a substantially hemispherical outer wall **12*a* integrated with a substantially funnel shaped inner wall 12*b*. The inner wall 12*b* has an upper converging end which defines an air access opening 15. A hollow cavity 121 is confined by the outer and inner walls 12*a* and 12*b*. A plurality of holes 16 are disposed around the lowest portion of the retaining member 12. The holes 16 serve as an outlet for water inside the cavity 121 and as auxiliary air access vents. The air tube 11 also has an air valve 18 used to inflate or deflate the air tube 11**.

The air pipe 20 has a first end portion 21 disposed inside the cavity 121 and attached to the connecting tube 23 of a float valve member fitted in the air access opening 15. The air pipe 20 extends out of the cavity 121 via an exit opening 17 of the inner wall **12*b*. The second end 22 of the air pipe 20 is connected to the face mask 30**.

The face mask 30 has a construction similar to conventional face masks. The face mask 30 comprises a lens 311 fixed to a skirt 32. The skirt 32 has a top portion with an opening 31 to receive the second end 22 of the air pipe 20. A strap 33 is provided on the face mask 30 so that it can be worn around the head.

When preparing to use the first preferred embodiment, the air tube 11 is first inflated and tested for air leakage. The face mask 30 is worn around the head and the user checks for obstruction of the air pipe 20. In use, air from the water surface flows freely into the air access opening 15, through the air pipe 20 and into the face mask 30. The user thus inhales through the nose and, by exhaling through the mouth, is provided with a constant source of fresh breathing air, thereby allowing the user to spend a much longer time underwater. The length of the air pipe 20 can be extended to provide greater freedom of movement for the user. This makes it possible for the user to dive deeper into the water. The length of the air pipe 20 can also be set to prevent the user from reaching depths where the water pressure becomes a great hazard.

The retaining member 12 is constructed to be above and at the center of the air tube 11. The air tube 11 can thus act as a buffer against surface turbulence, thus aiding in preventing water from reaching the air access opening 15.

The floating body 10 is designed to have a top portion that is smaller than the bottom portion, which bottom portion is in contact with the water surface, thus lowering its center of gravity and making the floating body 10 more stable. The floating body 10 is also designed to have low wind resistance.

The main features of the first preferred embodiment are as follows:

1. There is no need to use expensive oxygen tanks and regulators even in prolonged dives since air is supplied through the flexible air pipe 20, which is in constant communication with the atmosphere.

2. The length of the air pipe 20 can be set to prevent the user from reaching depths where the water pressure is hazardous. Furthermore, the air pipe 20 can withstand the water pressure and does not easily deform at these depths.

3. The air pipe 20 is flexible, thus permitting unrestricted movement of the user.

4. The preferred embodiment is compact and light weight. The floating body 10 is inflatable and the air pipe 20 can be coiled for storage.

5. The floating body 10 can serve as an indicator or as a location beacon for a second party when it is necessary to find the diver.

Figure 5:
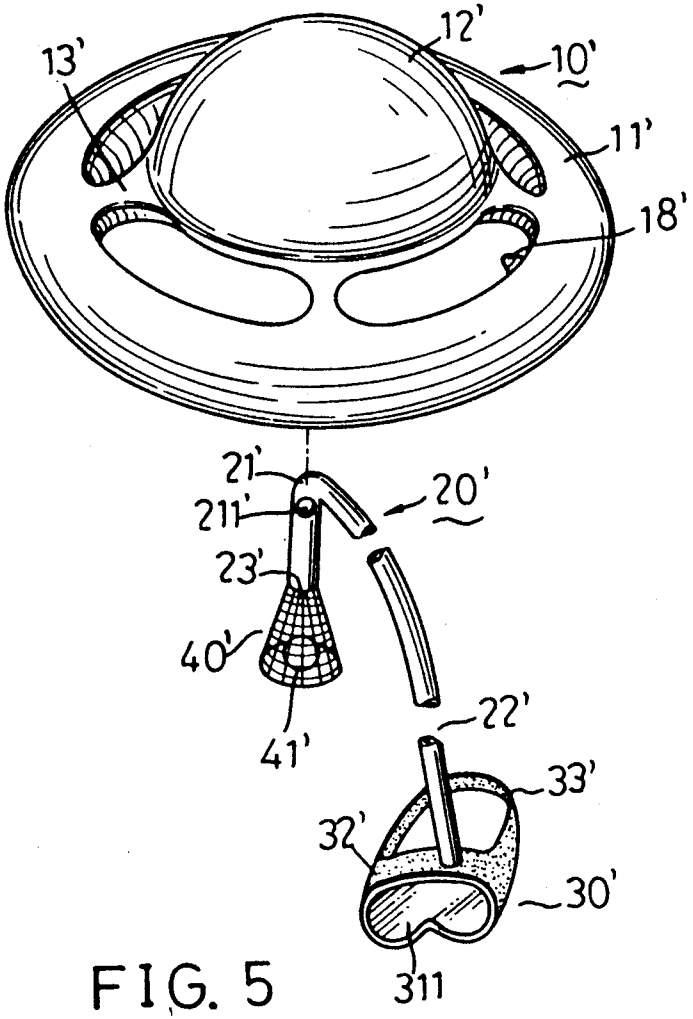
FIG. 5 is a perspective view of a second preferred embodiment of a snorkel assembly according to the present invention.
Figure 4:
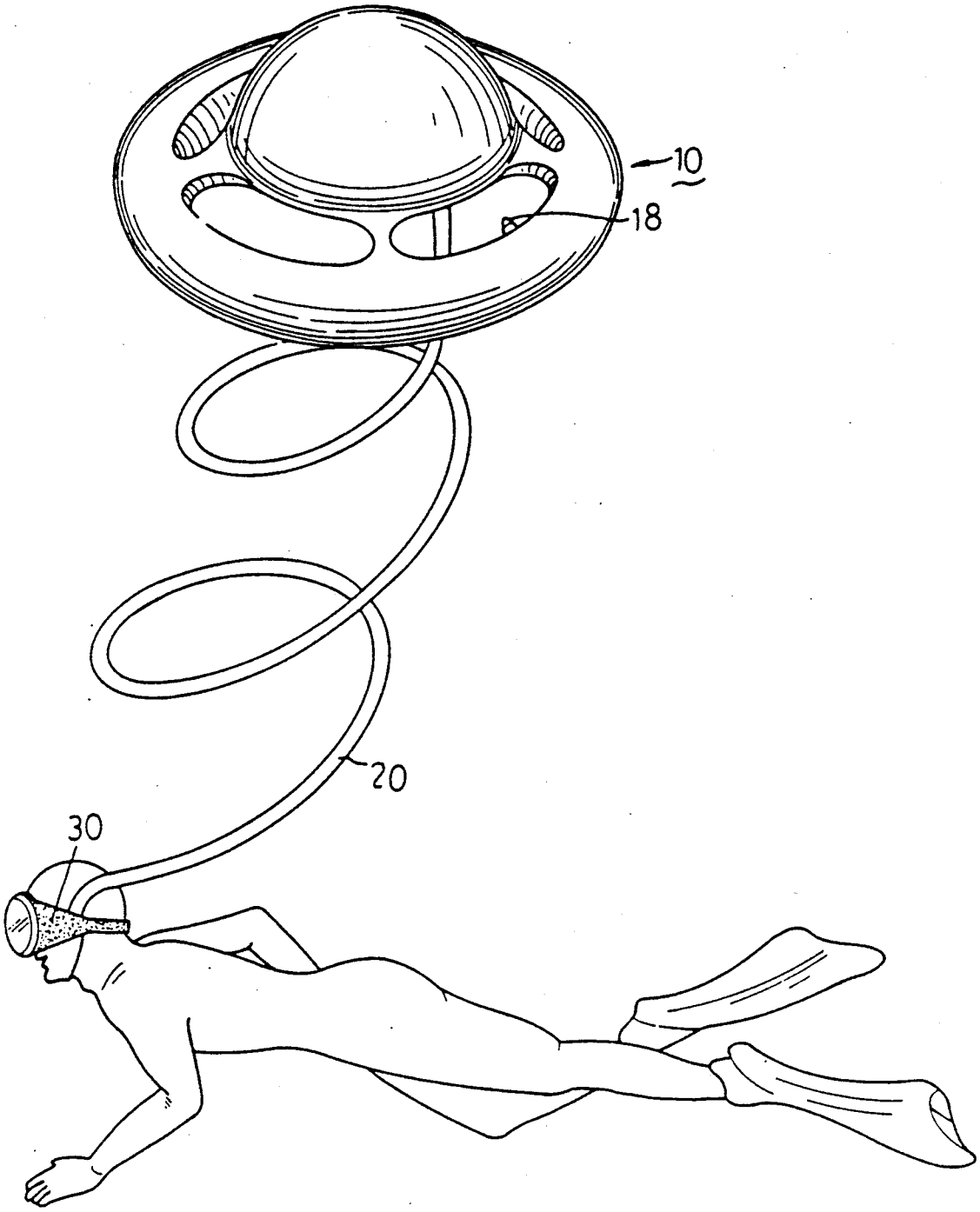
FIG. 4 illustrates the first preferred embodiment in use.
Figure 6:
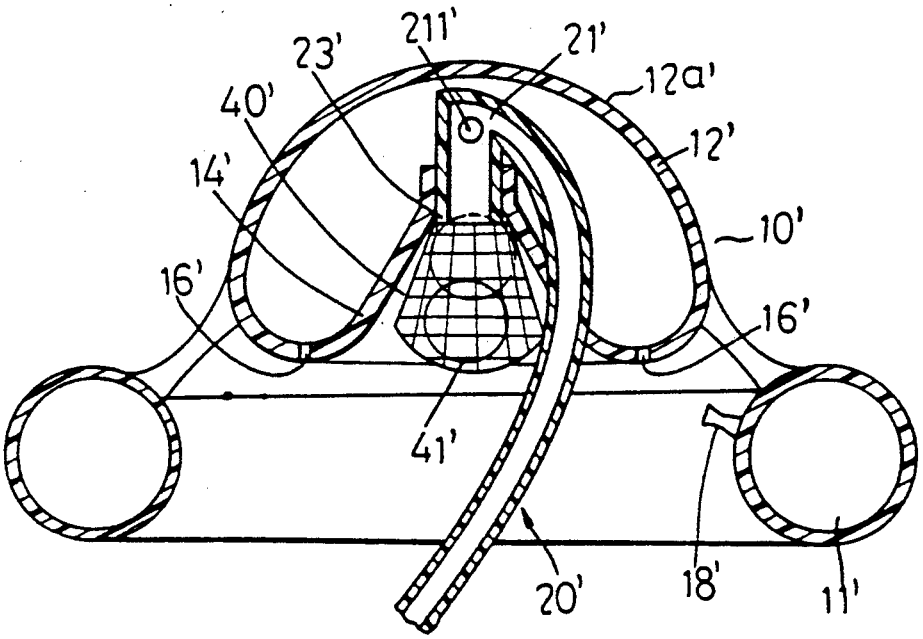
FIG. 6 is a sectional view of the second preferred embodiment of the present invention.

FIGS. 5 and 6 are illustrations of a second preferred embodiment of a snorkel assembly according to this invention. The second preferred embodiment has a construction similar to that of the first preferred embodiment and comprises a floating body 10', a flexible air pipe 20' and a face mask 30'. The air pipe 20' has an end portion 21' with a through hole 211'. The floating body 10' has a funnel shaped inner wall 14' which houses a cage 40' and a floating ball 41' contained in the cage 40'. The cage 40' is attached to a connecting tube 23' at the end 21' of the air pipe 20'. The floating ball 41' is light weight so that it can be easily moved by water fluctuations, thus allowing it to block the connecting tube 23' to prevent water from entering the air pipe 20'. Some air can still flow freely to the face mask 30' through the air hole 211'. Since the construction and operation of the second preferred embodiment is substantially similar to that of the first preferred embodiment, these items will not be detailed herein.

Figure 7:
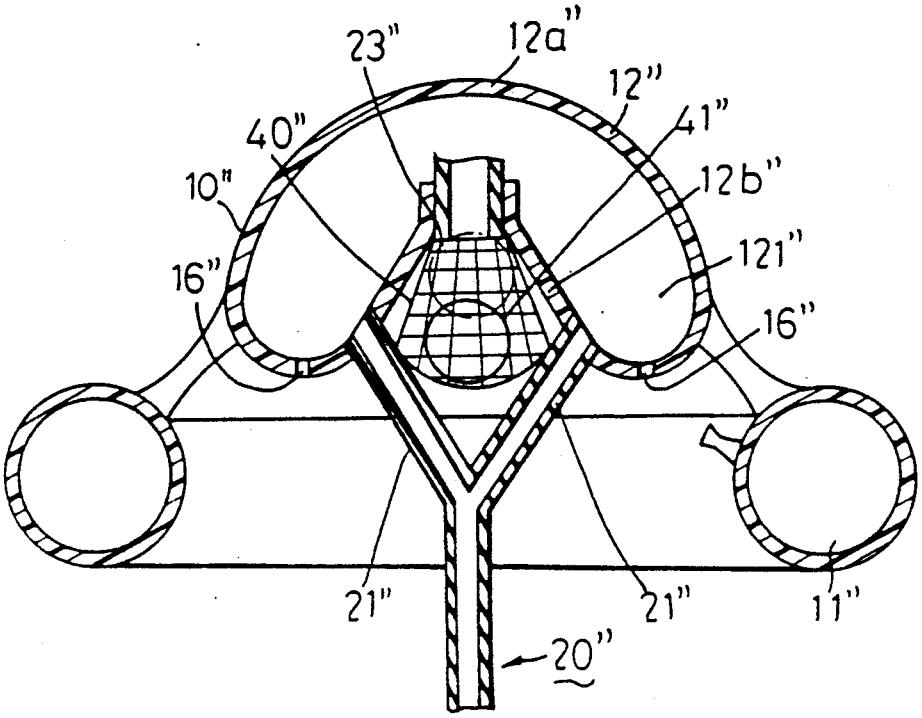
FIG. 7 is a sectional view of a third preferred embodiment of a snorkel assembly according to the present invention.

Referring to FIG. 7, a third preferred embodiment of a snorkel assembly according to the present invention is shown to also comprise a floating body 10'', a flexible air pipe 20'', a cage 40'', and a floating ball 41'' contained inside the cage 40''. The air pipe 20'' has a Y-shaped end portion 21'' connected to two locations on the inner wall **12*b*'' of the floating body 10''. The cage 40'' has a base supported by the Y-shaped end portion 21'' and a top end attached to the connecting tube 23''. As with the second preferred embodiment, the floating ball 41'' is light weight so that it can be easily moved by water fluctuations, thus allowing it to block the connecting tube 23'' to prevent water from entering the cavity 121''**.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A snorkel assembly, comprising:

a face mask;

an elongated flexible air pipe having two end portions, one end portion being connected to said face mask; and a floating body connected to the other end portion of said air pipe to expose said other end portion to the atmosphere, said floating body including an inflatable ring shaped air tube and a rigid hollow retaining member connected to said air tube, said retaining member having an air access opening and supporting said other end portion of said air pipe, said retaining member further having a plurality of holes formed at the portion thereof nearest the water level.

2. The snorkel assembly as claimed in claim 1, further comprising a plurality of upwardly inclining connecting ribs to join said retaining member to said air tube.

3. The snorkel assembly as claimed in claim 1, wherein said retaining member has a substantially hemispherical outer wall and a substantially funnel shaped inner wall integrated with said outer wall, said inner wall having an upper converging portion defining said air access opening, said outer wall and said inner wall confining an enclosed hollow cavity.

4. The snorkel assembly as claimed in claim 3, wherein said retaining member has an air pipe opening, said other end portion of said air pipe extending into said retaining member through said air pipe opening, said other end portion of said air pipe being fitted in and communicated with said air access opening.

5. The snorkel assembly as claimed in claim 4, wherein said float valve member has a connecting tube fitted in said air access opening, said snorkel assembly further comprising a cage member attached to said connecting tube and disposed outside said air access opening, and a floating ball disposed inside said cage member to block said connecting tube.

6. The snorkel assembly as claimed in claim 3, further comprising a float valve member at said air access opening to prevent water from breaching said air access opening.

7. The snorkel assembly as claimed in claim 3, wherein said retaining member has an air pipe opening, said other end portion of said air pipe extending into said retaining member through said air pipe opening and being fitted in said air access opening, said other end portion having a terminating open end, said snorkel assembly further comprising a cage member attached to said other end portion at said terminating open end and disposed outside said air access opening, and a floating ball disposed inside said cage member to block said terminating open end.

8. The snorkel assembly as claimed in claim 7, wherein said other end portion of said air pipe has a through hole disposed inwardly of said terminating open end to communicate said other end portion with said hollow cavity.

9. The snorkel assembly as claimed in claim 5, wherein said other end portion of said air pipe has a substantially Y-shaped portion attached to said inner wall and communicated with said hollow cavity.

10. The snorkel assembly, comprising:

a face mask;

an elongated flexible air pipe having two end portions, one end portion being connected to said face mask; and a floating body connected to the other end portion of said air pipe to expose said other end portion to the atmosphere, said floating body including an inflatable ring shaped air tube and a rigid hollow retaining member connected to said air tube, said retaining member having an air access opening and supporting said other end portion of said air pipe, said retaining member further having a substantially hemispherical outer wall and a substantially funnel shaped inner wall integrated with said outer wall, said inner wall having an upper converging portion defining said air access opening, said outer wall and said inner wall confining an enclosed hollow cavity; and a float valve member at said air access opening to prevent water from breaching said air access opening, wherein said float valve member has a connecting tube fitted in said air access opening, said snorkel assembly further comprising a cage member attached to said connecting tube and disposed outside said air access opening, and a floating ball disposed inside said cage member to block said connecting tube, wherein said other end portion of said air pipe has a substantially Y-shaped portion attached to said inner wall and communicated with said hollow cavity.

* * * * *